US010643583B2

(12) United States Patent
Greenhouse

(10) Patent No.: US 10,643,583 B2
(45) Date of Patent: May 5, 2020

(54) STRINGED INSTRUMENT FINGER BOARD

(71) Applicant: Max Greenhouse, Riverside, CA (US)

(72) Inventor: Max Greenhouse, Riverside, CA (US)

( * ) Notice: Subject to any disclaimer, the term of this patent is extended or adjusted under 35 U.S.C. 154(b) by 220 days.

(21) Appl. No.: 15/892,668

(22) Filed: Feb. 9, 2018

(65) Prior Publication Data

US 2019/0108818 A1 Apr. 11, 2019

Related U.S. Application Data

(60) Provisional application No. 62/569,417, filed on Oct. 6, 2017.

(51) Int. Cl.

| | |
|---|---|
| ***G10D 3/06*** | (2020.01) |
| ***G10D 1/08*** | (2006.01) |
| *G10D 1/02* | (2006.01) |

(52) U.S. Cl.

CPC ..... *G10D 3/06* (2013.01); *G10D 1/08* (2013.01); *G10D 1/02* (2013.01)

(58) Field of Classification Search

CPC ..... G10D 3/06; G10D 1/08; G10D 1/02
USPC ..... 84/314 R
See application file for complete search history.

(56) References Cited

U.S. PATENT DOCUMENTS

| | | | | |
|---|---|---|---|---|
| 281,584 | A * | 7/1883 | Van Haagen | G10D 3/06 84/314 R |
| 3,787,600 | A * | 1/1974 | Muncy | G10D 3/06 84/314 R |
| 3,894,468 | A | 7/1975 | Dunlap | |
| 4,189,974 | A | 2/1980 | Martin et al. | |
| 4,334,456 | A * | 6/1982 | Martin | G10D 3/06 84/314 R |
| D704,766 | S | 5/2014 | Fraser et al. | |

* cited by examiner

*Primary Examiner* — Jianchun Qin
(74) *Attorney, Agent, or Firm* — Kirk A. Buhler; Buhler & Associates Patenting

(57) ABSTRACT

Improvements in a stringed instrument finger board is disclosed. The finger board customizes the metal edge on the frets adding vertical indented scalloped elongated slots. The slots are created between each fret without actually cutting grooves into the actual wood on the fretboard. The design can also work with a fretless embodiment with vertical indented scallop shape elongated slots cut in between each string where the strings aren't sitting on any frets. A guitarist can pull any string on the fretboard up or down into the slots to create new bending techniques. The frets can have an angled edge to adjust the tone and allow bending the string(s) over the frets. The neck groove allows altering the string pitch, bending the string into the groove for to add an extra X-note or a ghost note beat to a 2 note pull off to add a triplet.

17 Claims, 10 Drawing Sheets

STRINGED INSTRUMENT FINGER BOARD

CROSS REFERENCE TO RELATED APPLICATION

This application claims the benefit of Provisional Application Ser. No. 62/569,417 filed Oct. 6, 2017 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a stringed instrument finger board. More particularly, the present fingerboard design customizes the metal edge on the frets to alter the pitch differently than a standard bend on any string to reach higher notes, play x-notes (ghost note) or clicking sounds, create note variations to chords or octave chords, add different vibrato to bends, and to create triplets when doing finger pull off and hammer techniques on the strings. The guitar can potentially reach higher notes by using the fret corner bend than a standard bend, depending on the design of the edges and the specific location of the fret on the neck.

Description of Related Art Including Information Disclosed Under 37 CFR 1.97 and 1.98

When a person plays a stringed fretted musical instrument, the frets allow the person to play a note at a particular tone. An experienced musician likes to alter the tone to provide additional variation. To perform tone altering in a standard stringed fretted instrument the performer must pull the string(s) off center. While this allows for altering the tone, the player is limited to the proximity to adjacent strings and does not have the ability to pull the strings into a vertical indented scallop shape elongated slot cut between each string over the edge of the fret corner. A number of patents and or publications have been made to address these issues. Exemplary examples of patents and or publication that try to address this/these problem(s) are identified and discussed below.

U.S. Pat. No. 3,894,468 issued on Jul. 15, 1975 to Philip A. Dunlap discloses a Stringed Instrument with Sliding Variability Spaced Frets. In this patent the fret block includes means to move the frets longitudinally along the fret block relative to one another as a function of the position of the fret block on the neck, so that as the block slides on the neck. While this patent allows for altering the tone from the strings, it accomplishes the tone changes by moving frets as opposed to allowing additional vertical room to bend the strings.

U.S. Pat. No. 4,189,974 issued on Feb. 26, 1980 to James O. Martin et al., discloses a Guitar Neck Assembly. The guitar assembly including an elongated, channel-shaped, open-top, neck body upon which are mounted a plurality of longitudinally spaced, transversely disposed, free-spanning fret bars. The neck is hollow metal and the frets are bent from the hollow metal neck. While this provides a space to further depress the strings, it does not provide a stop on the fingerboard for chromatic notes.

U.S. Pat. No. 4,334,456 issued on Jun. 15, 1982 to James O. Martin et al., discloses a Guitar Neck Fret Assembly. The fret assembly comprises of a ladder-like structure including a pair of elongated support rods upon which are fixed a plurality of longitudinally spaced, transverse fret bars, and a clamp member for detachably securing the support rods longitudinally upon the top surface of the neck body. With this invention there is no fixed structure to set the location of the frets on the fingerboard.

What is needed is a stringed instrument finger board that allows a player to play notes in normal tone and also bend any or all of the strings at any fret over the edge of the fret corner into a vertical indented scallop shaped elongated slot that runs the entire or partial length of the fretboard to change the pitch, create new string bend techniques, and add 1 extra beat to a standard 2 note pulloff to create a triplet. The stringed instrument finger board in this document provides the solution.

BRIEF SUMMARY OF THE INVENTION

It is an object of the stringed instrument finger board to alter and customize the metal edges of the frets by adding them in between the strings and at the far edge of the fret boards. The strings will be set at the perfect tension, and action (height off neck) to create clear tones when bending the strings over the edge of the fret corners. This custom metal edge allows experimental guitar sounds for blues, jazz, rock, hip hop, classical guitar, metal, cultural music, and solos by altering the pitch differently than a standard bend to play higher notes, create x-note (ghost note) or clicking sounds, add note variations to chords or octave chords, add different vibrato to bends, and to create triplets when doing finger pull off and hammer techniques on the strings. The gaps can go through or just partially enough so the effect works.

It is an object of the stringed instrument finger board to allow a guitar player to bend any individual string over the edge of the custom angled fret corner which leads into a vertical indented scallop shaped elongated groove or slot running the entire length of the fretboard top or bottom cut in between each string with custom angled fret edges on the sides allowing the string to bend directly inside. With this innovation of adding elongated vertical slots in between each string running the entire length of the neck or at specific points in the center of the guitar neck it allows a guitarist to use this playing technique on any string. With this innovation of adding custom elongated slots and or angled fret corner edges with grooves cut into the wood at specific points in the center of the guitar neck it allows a guitarist to use this playing technique on any string.

It is an object of the stringed instrument finger board to utilize vertical indented scallop shaped grooves or slots running the entire length of the fretboard top to bottom cut in-between each string with custom angled fret edges on both sides allowing the string to bend directly inside to create tonal effects. The vertical scallop shaped slots are created in between each fret by cutting grooves into the actual wood on the fretboard. The vertical cuts between the frets can be elongated rounded, scalloped or square shaped to allow the player to bend the string over the edge of the fret corner into the slot creating note variations. The slots can go the entire length of the neck or just partially to get the desired sound.

It is another object of the stringed instrument finger board to be fretless with vertical indented scallop shaped elongated slots running the entire or partial length of the fretboard cut in-between each string because the strings aren't sitting on any frets. The frets are completely flush with the neck so when you pull the string, the string will go perfectly over the edge.

It is another object of the stringed instrument finger board is for the fret corner edge leading into the custom vertical indented scallops between each string to have a rounded or sharp angle to adjust the tone when performing bends.

It is still another object of the stringed instrument finger board to allow performers to reach higher notes with each fret corner bend at specific frets on the guitar using any string by bending the string either up or down. Bending the string over the angled edge of the fret corner into the vertical indented elongated scallop shaped slot creates new tones by altering the length of the string, tension on the string, pitch, and sound of the note.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

Figure 5:
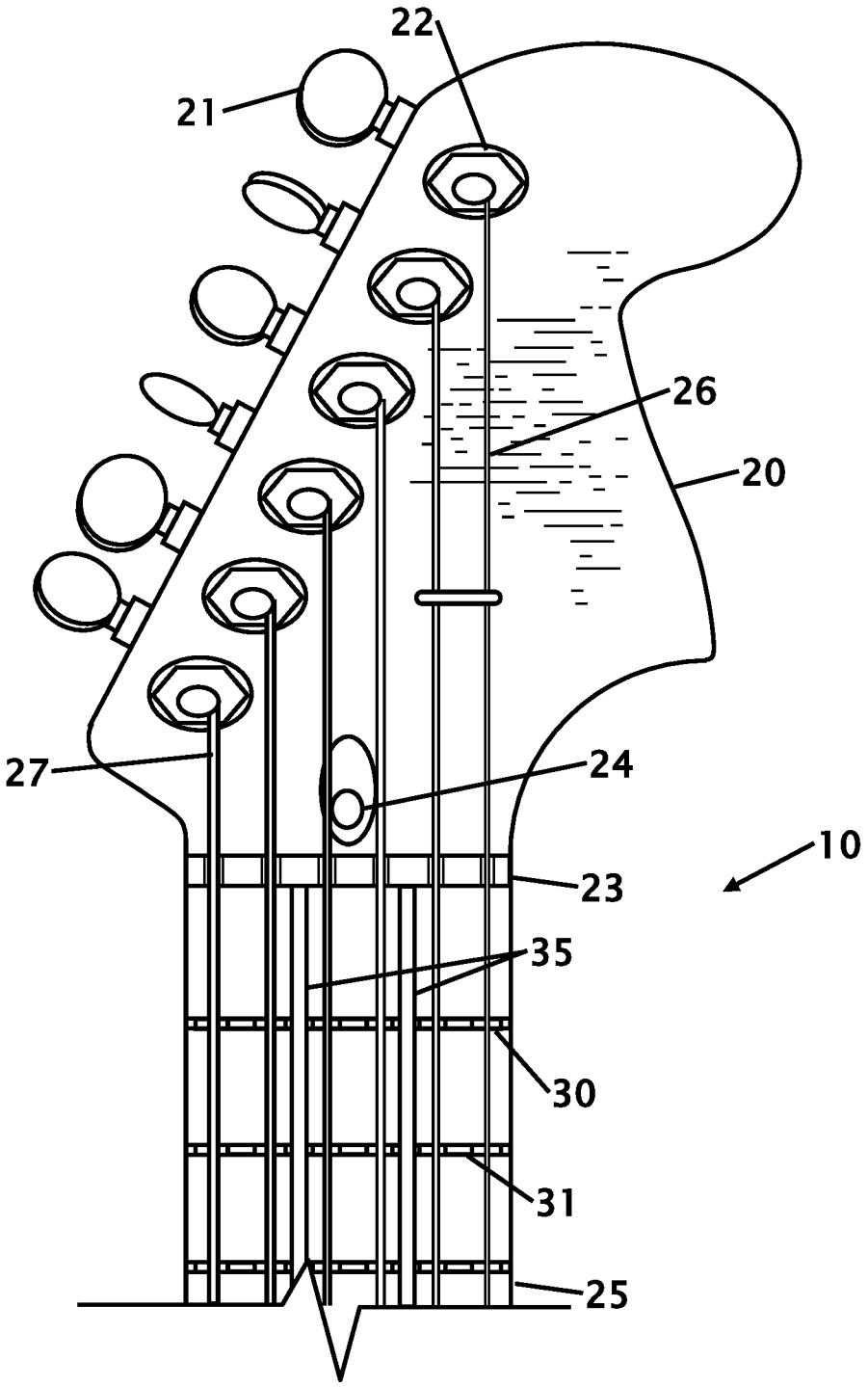

FIG. 5 Slots placed in between the $3^{rd}$ and $2^{nd}$ string, and the $5^{th}$ and $4^{th}$ string.

Figure 6:
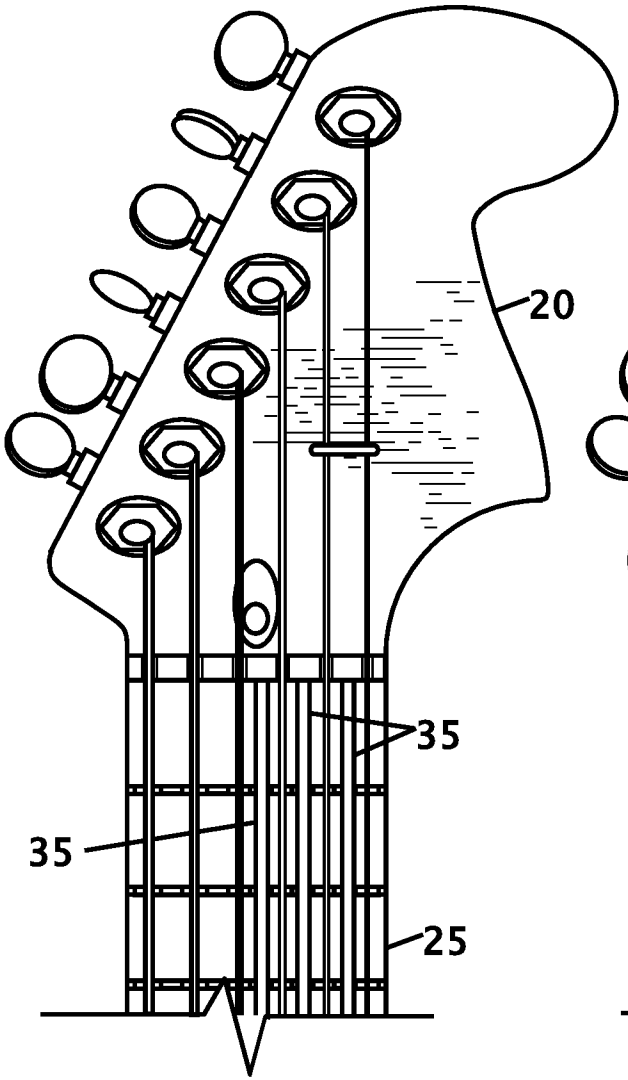

FIG. 6 has slots placed in between the upper four strings.

Figure 7:
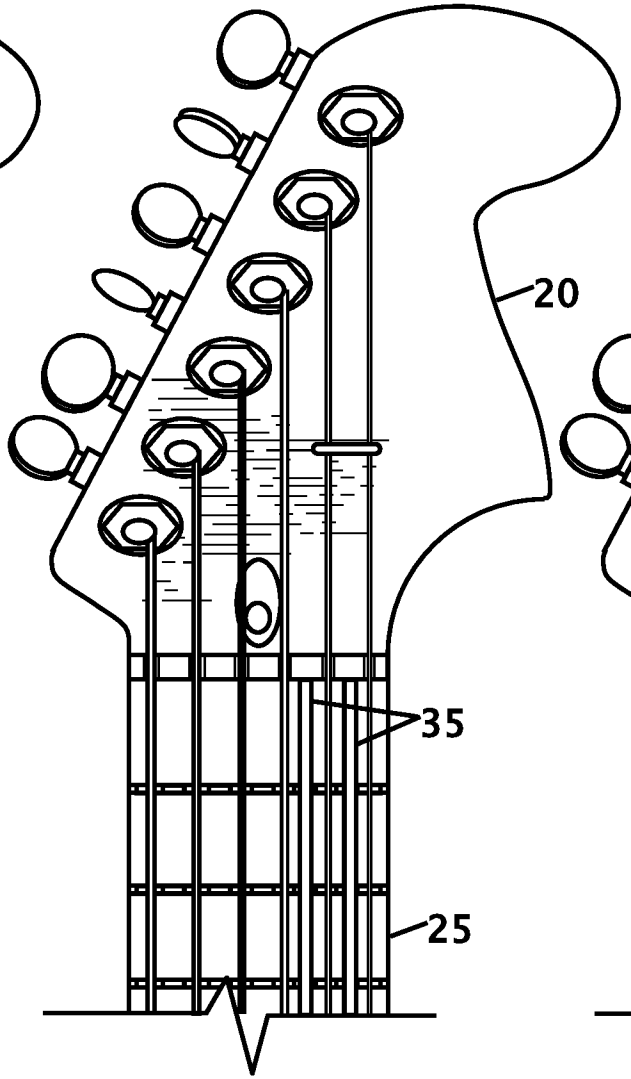

FIG. 7 has slots placed in between the upper three strings.

Figure 8:
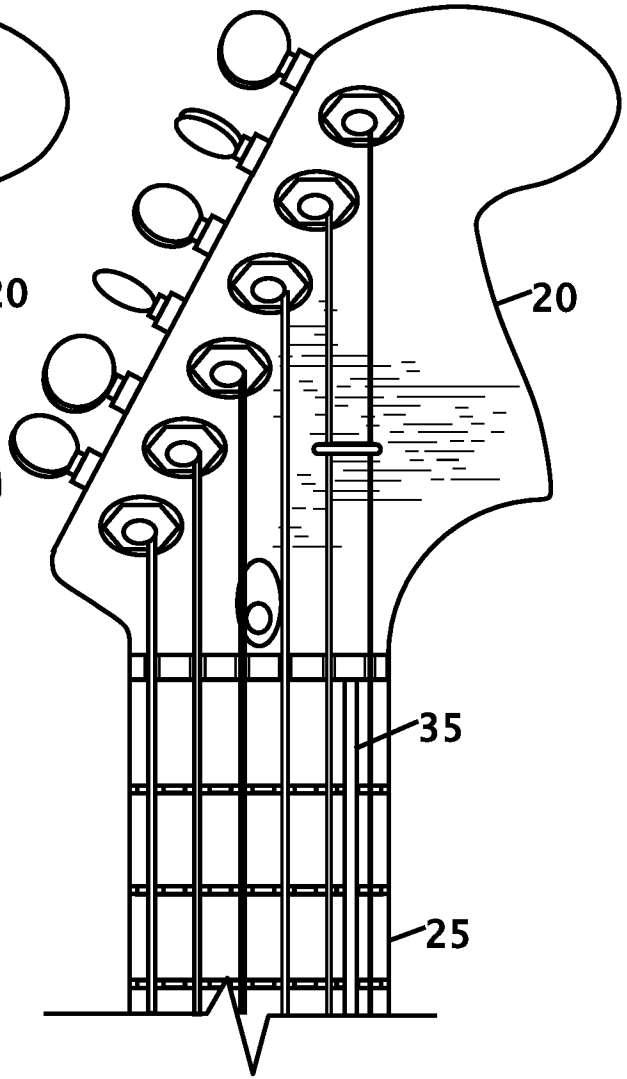

FIG. 8 has slots placed in between the upper two strings.

Figure 9:
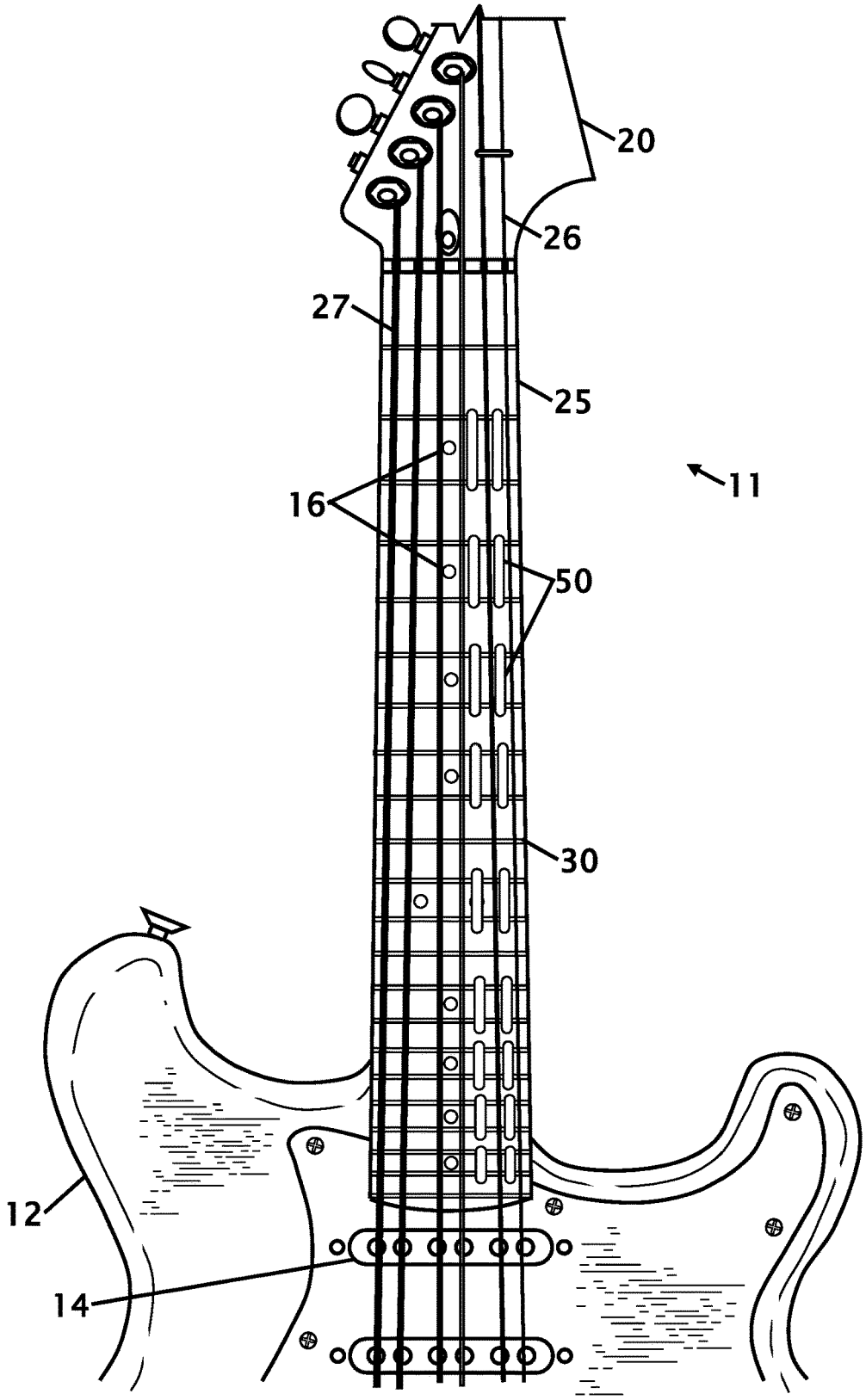

FIG. 9 shows a guitar neck with fret corner slots at select locations on the neck.

Figure 10:
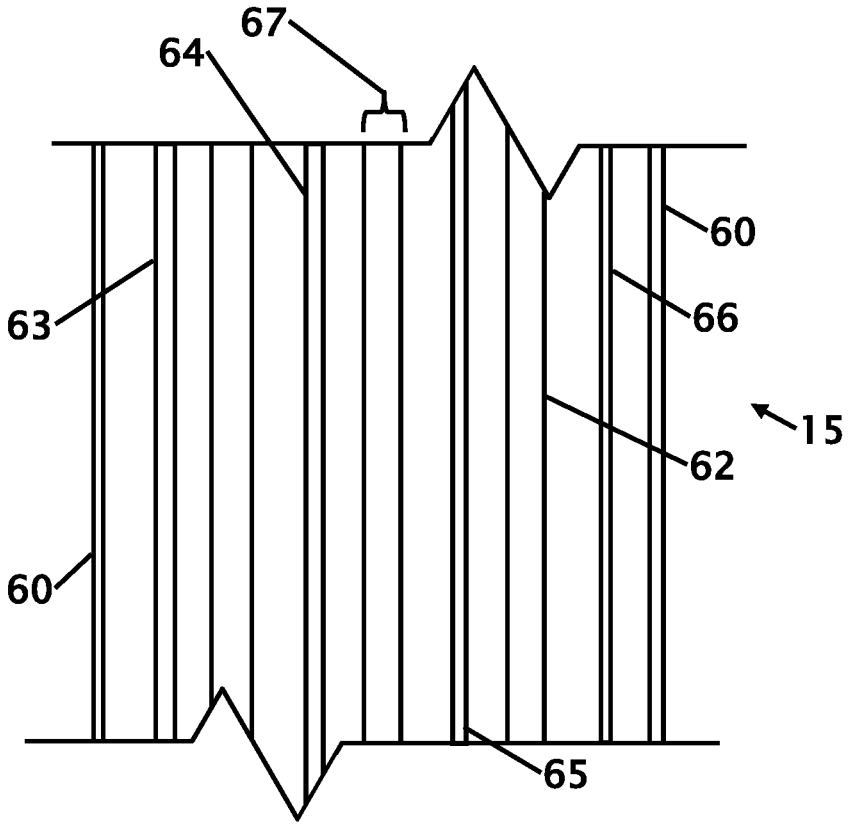

FIG. 10 shows a fretless neck embodiment with frets running the length of the fingerboard.

Figure 11:
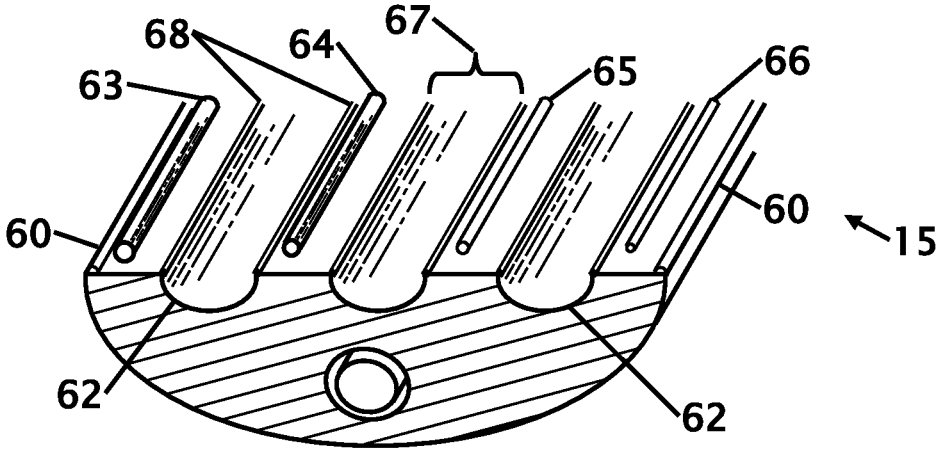

FIG. 11 is an oblique view of the fretless neck with frets running the length of the fingerboard.

Figure 12:
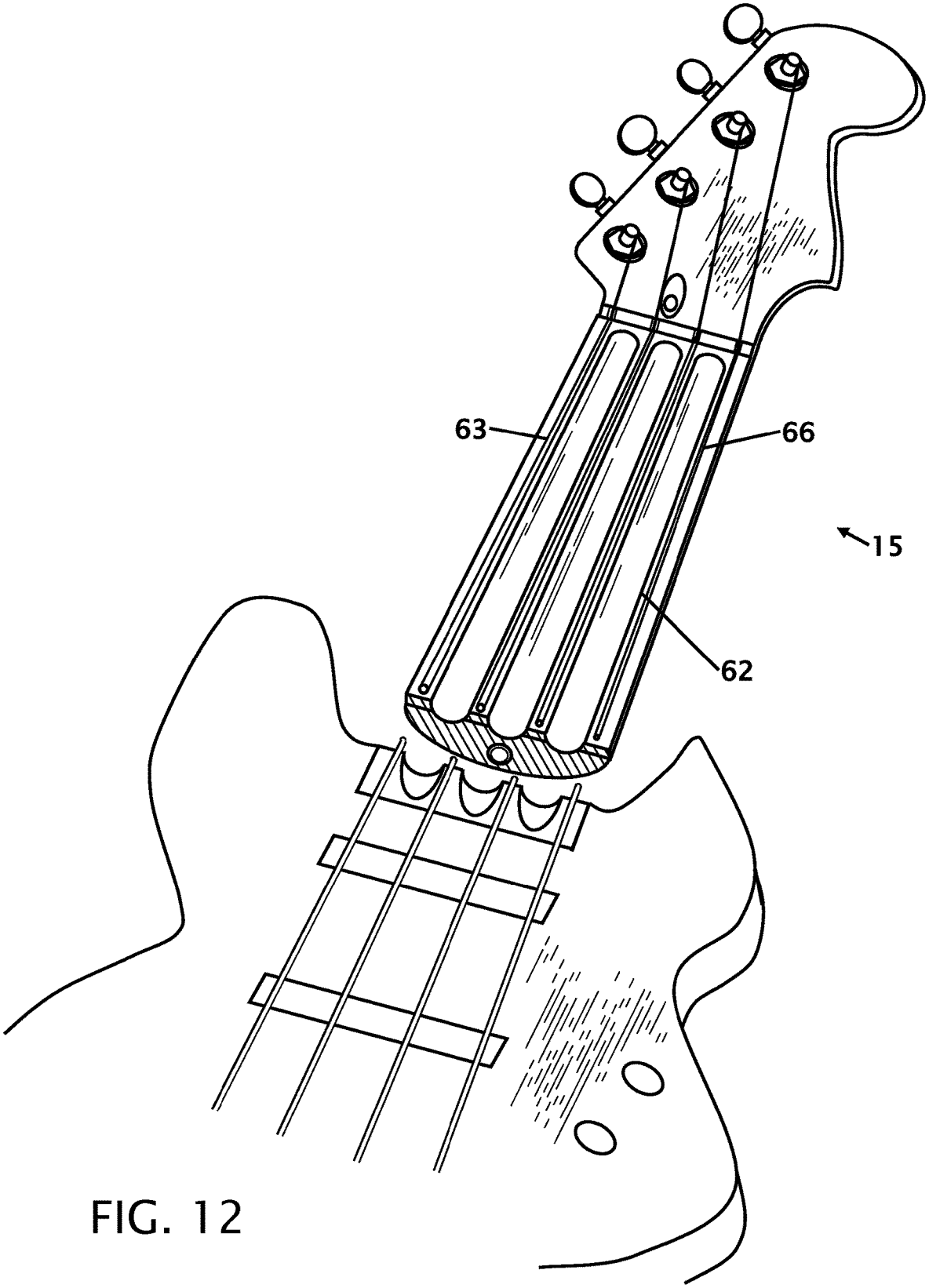

FIG. 12 shows an oblique view of a portion of a fretless base guitar.

Figure 13:
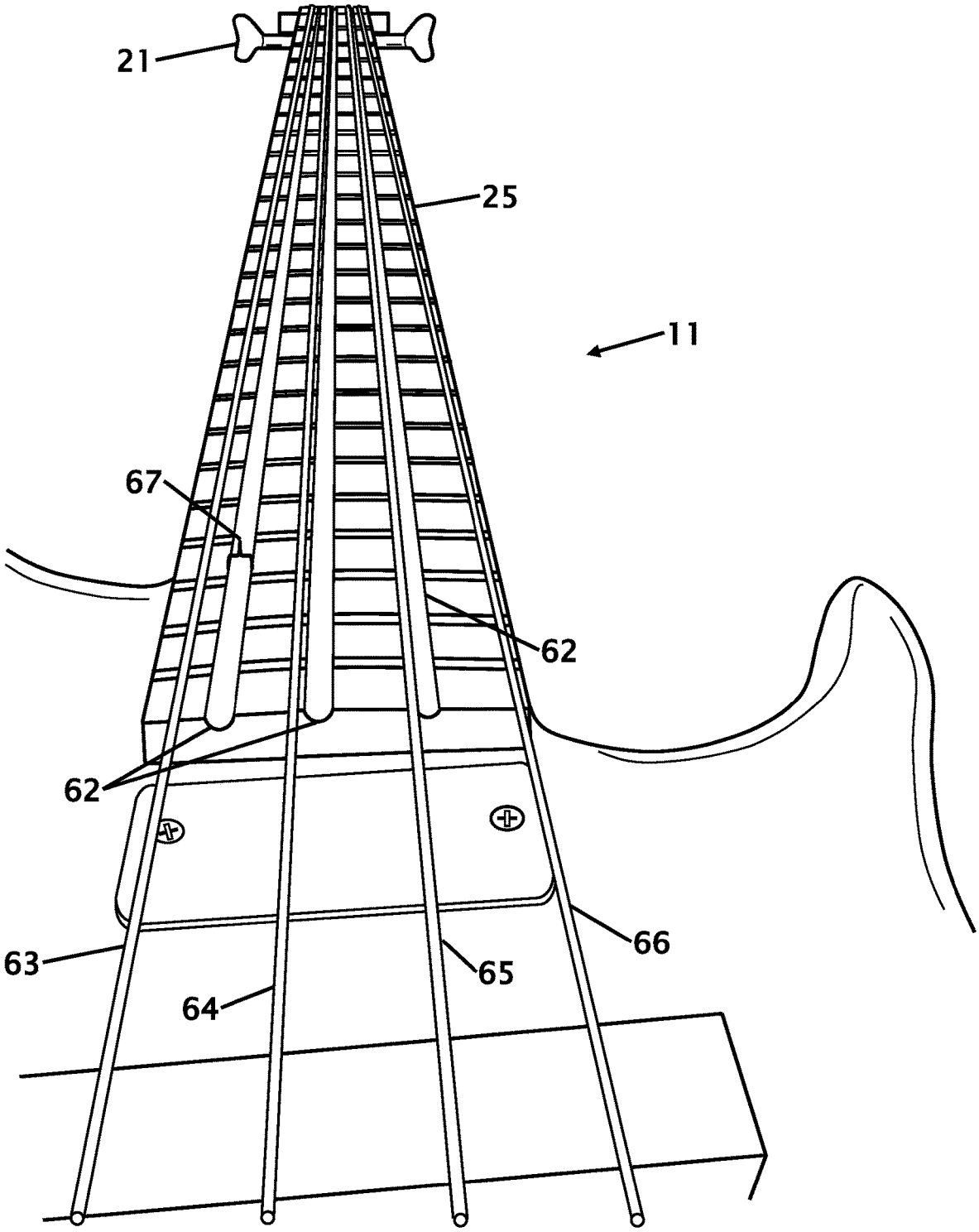

FIG. 13 shows an oblique view of a portion of a fretted four string guitar.

DETAILED DESCRIPTION OF THE INVENTION

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

ITEM NUMBERS AND DESCRIPTION

10 stringed instrument
11 stringed instrument
12 body
14 pick-ups
15 neck
16 dots
19 guitar
20 head
21 pegs or machines
22 capstans
23 nut
24 tension rod adjuster
25 fingerboard
26 high string
27 low string
30 frets
31 angled or angled cuts
33 fret
34 area between strings
35 slots
36 fret
37 fret
40 square shape
41 rounded scallop
42 "V" shape,
43 chamfered bottom edges
44 recess
45 variation
50 slots
60 elongated metal frets
62 recesses
63, 64, 65, 66 strings
67 elongated slots
68 metal fret corners The general embodiments of the stringed instrument 10, and guitar fret board design. As a general understanding of the different embodiments that are contemplated the below description of different elements will provide an overview.

1) The metal edge of each guitar fret corner has a custom shape and angle design thereby allowing the edge to give the string the perfect clean pitch and full range when performing the fret corner bend by pulling the string into the edge of the fret corner into a vertical indented elongated scalloped shaped slot cut between each string spanning the entire length or partial length of the fretboard.

2) Each vertical indented elongated scalloped shaped groove or elongated slot can either be in the shape of a rounded scallop or can be an angled shape slot. The slot should be an extension of the angled edge on the fret corner and be the perfect width and depth so the string fits inside and does not get stuck.

3) Each vertical indented scalloped shaped elongated slot will have angled 2 fret corners on each side located in-between each string on the fretboard that are placed directly on the edge and allow the string to bend inside.

4) The vertical indented scalloped shaped elongated slots will go deep enough to make the effect work properly with full range of sound, but will not go too deep to weaken the structure of the neck or interfere with the truss rod.

5) The tuning of the guitar will affect what notes each fret corner bend will reach.

6) Different guitar strings will make different notes when bending a string over the fret corner inside the vertical indented scalloped elongated slots due to the string material, string wrap and bend radius.

7) Guitarists can bend a string over the fret corner inside the vertical indented scalloped elongated slots cut between each string on the fretboard on multiple strings at the same time to produce different chords.

8) The effect of bending a string inside the vertical indented scalloped elongated slots cut in-between each string can work on both fretted and fretless stringed instruments that have a fingerboard.

9) The effect of bending a string inside the vertical indented scalloped elongated slots cut in-between each string can work on both fretted and fretless stringed instruments that have a fingerboard.

Figure 1:
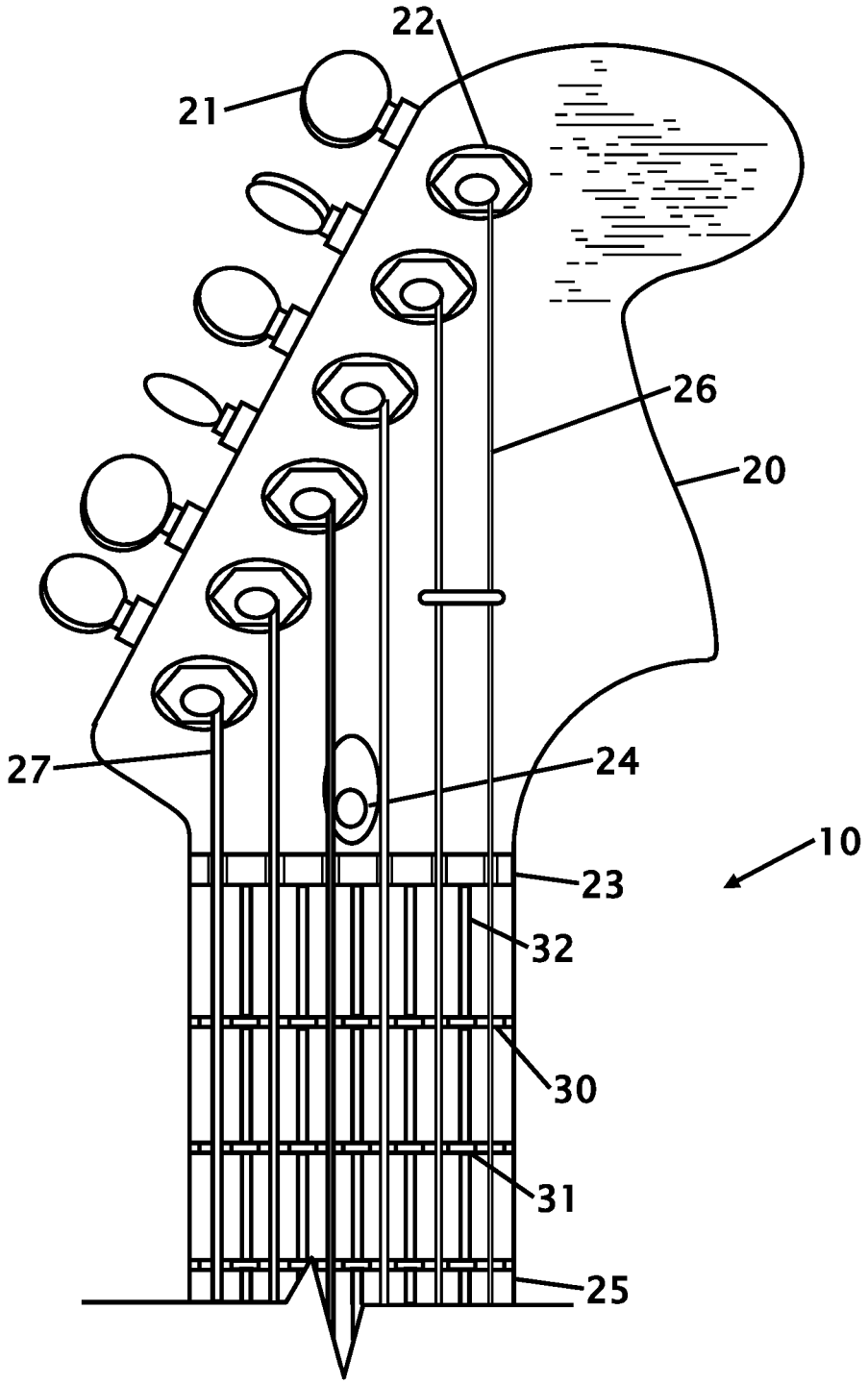
FIG. 1 shows the upper head of a guitar with grooved frets and side frets.

FIG. 1 shows the upper head of a guitar 19 with grooved frets and side frets as a standard slot version. The head 20 of the guitar has a plurality of tuning pegs or machines 21 that tension the strings by wrapping the strings around capstans 22 to tune the guitar to specific notes. In this figure there are six strings from a low string 27 that produces low tones to a high string 26 that produces higher tones. The head 20 of the guitar has an opening for a tension rod adjuster 24. Adjusting the tension alters the bend of the neck/fingerboard 25 to change the height of the strings above the frets and fingerboard 25. The strings go over a nut 23 that sets the initial height of the strings above the fingerboard 25.

This embodiment uses frets 30 that have metal strips 32 that are elongated along between the strings. The frets 30 further have angled cuts at the edges of the frets with recesses 31 or grooves alongside the edges. Angled cuts 31 at the edge of each fret connects to the inside of the slot so the string can slide over the edge of the fret corner inside of the slot. The slots 31 are wide enough so the string can resonate properly when the string is presses straight down.

Figure 2A:
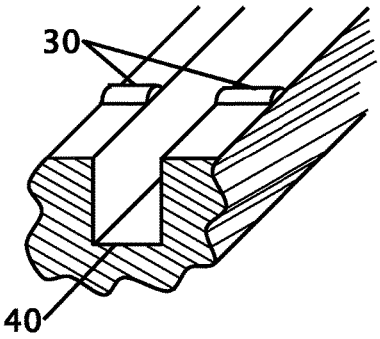
FIG. 2A-2I show some contemplated neck recesses.
Figure 2B:
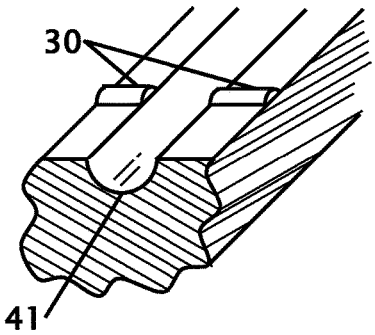
Figure 2C:
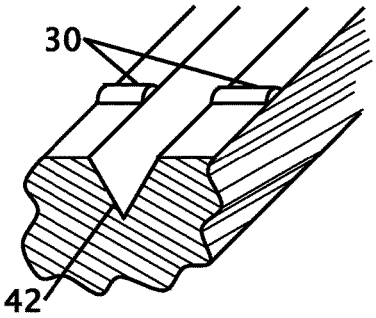
Figure 2D:
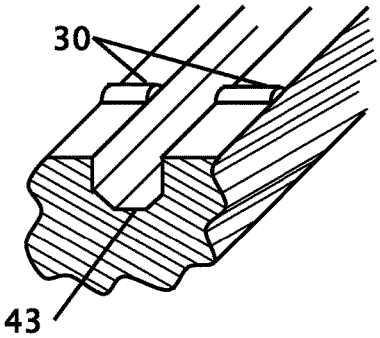
Figure 2E:
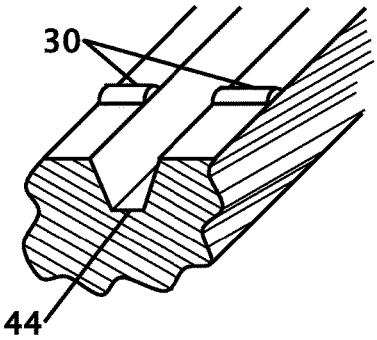
Figure 2F:
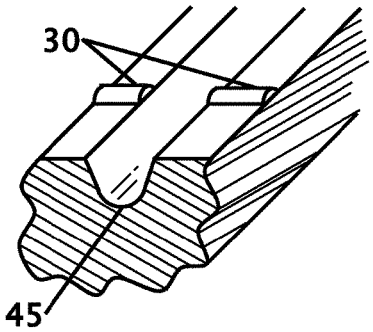
Figure 2G:
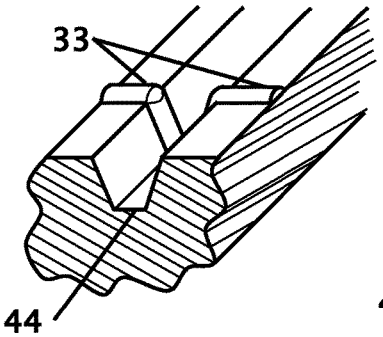
Figure 2H:
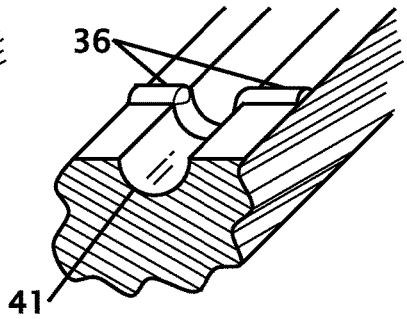
Figure 2I:
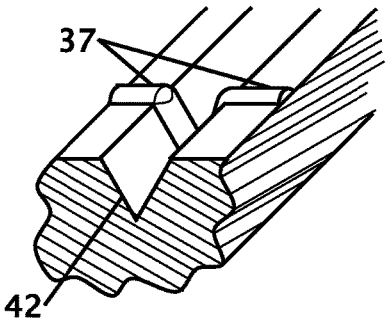

FIG. 2A-2I show some contemplated neck recesses. These different embodiments show some contemplated variations, but other variations are also contemplated to provide equivalent or superior sonic results. FIG. 2A shows a square 40 shape. FIG. 2B shows a rounded scallop 41 shape. FIG. 2C shows a "V" 42 shape. FIG. 2D shows a square shape with chamfered bottom edges 43. FIG. 2E shows a variation of the recess 44 of the embodiment from FIG. 2A. FIG. 2F shows a variation 45 from FIG. 2B with angled sides. These shapes are extensions of the actual fret 30 corner going into the slot. FIG. 2G shows a variation of the embodiment of FIG. 3E with the fret 33 extending through the recess 44. FIG. 2H shows a variation of the embodiment in FIG. 2B with a fret 36 conforming to the recess 41. FIG. 2I shows a variation of the embodiment shown in FIG. 2C with the fret 37 extending in the recess 42.

Figure 3:
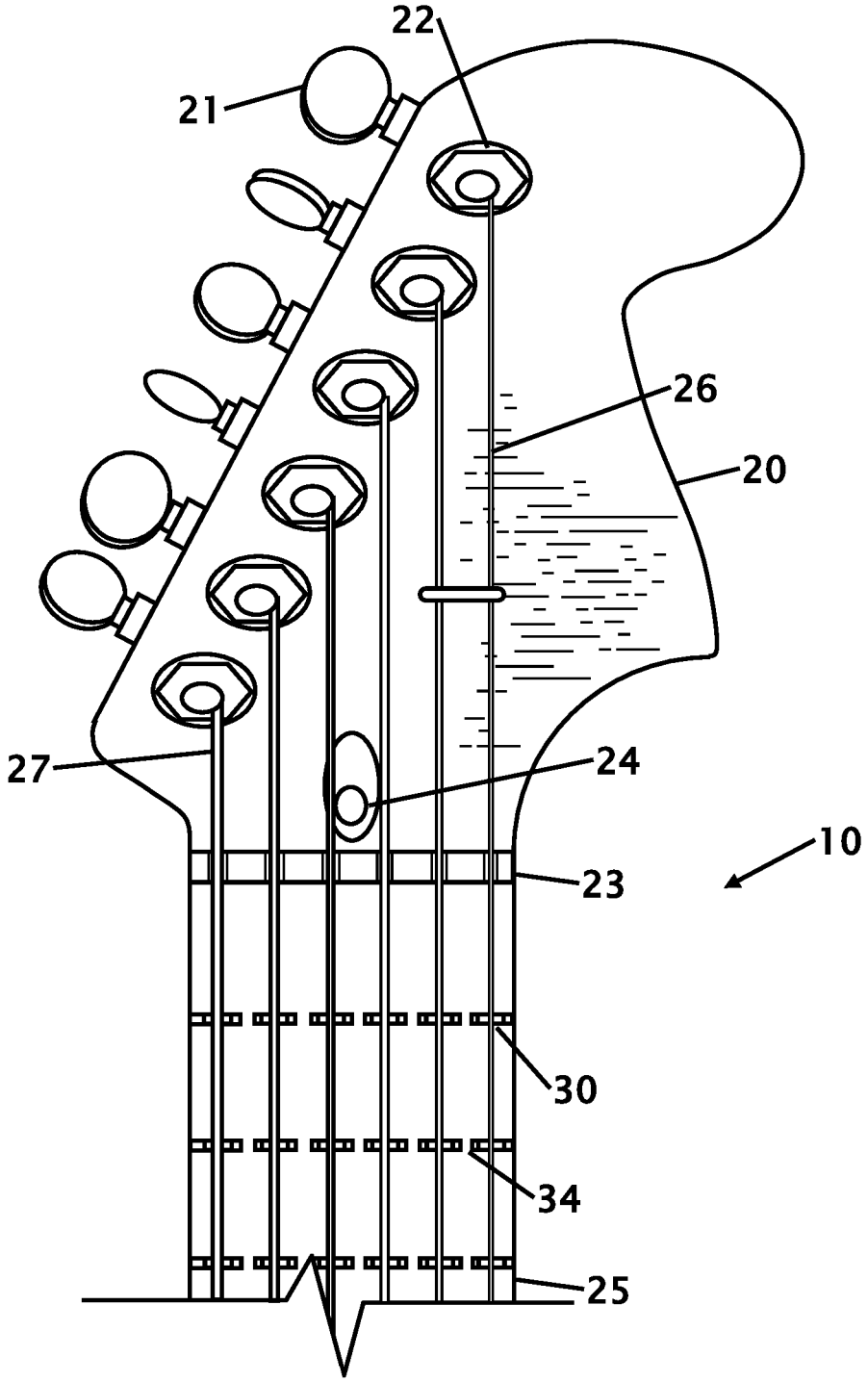
FIG. 3 shows the upper head of a guitar with grooved frets.

FIG. 3 shows the upper head of a guitar with grooved frets 30. The frets 30 have spaces between the normal ply area of the strings 26-27. This variation allows the player to play the guitar in a normal manner and obtain the normal pitch. When the strings are bent off center the strings can be brought into the area between 34 the fret sections and the sound from the string(s) are affected.

Figure 4:
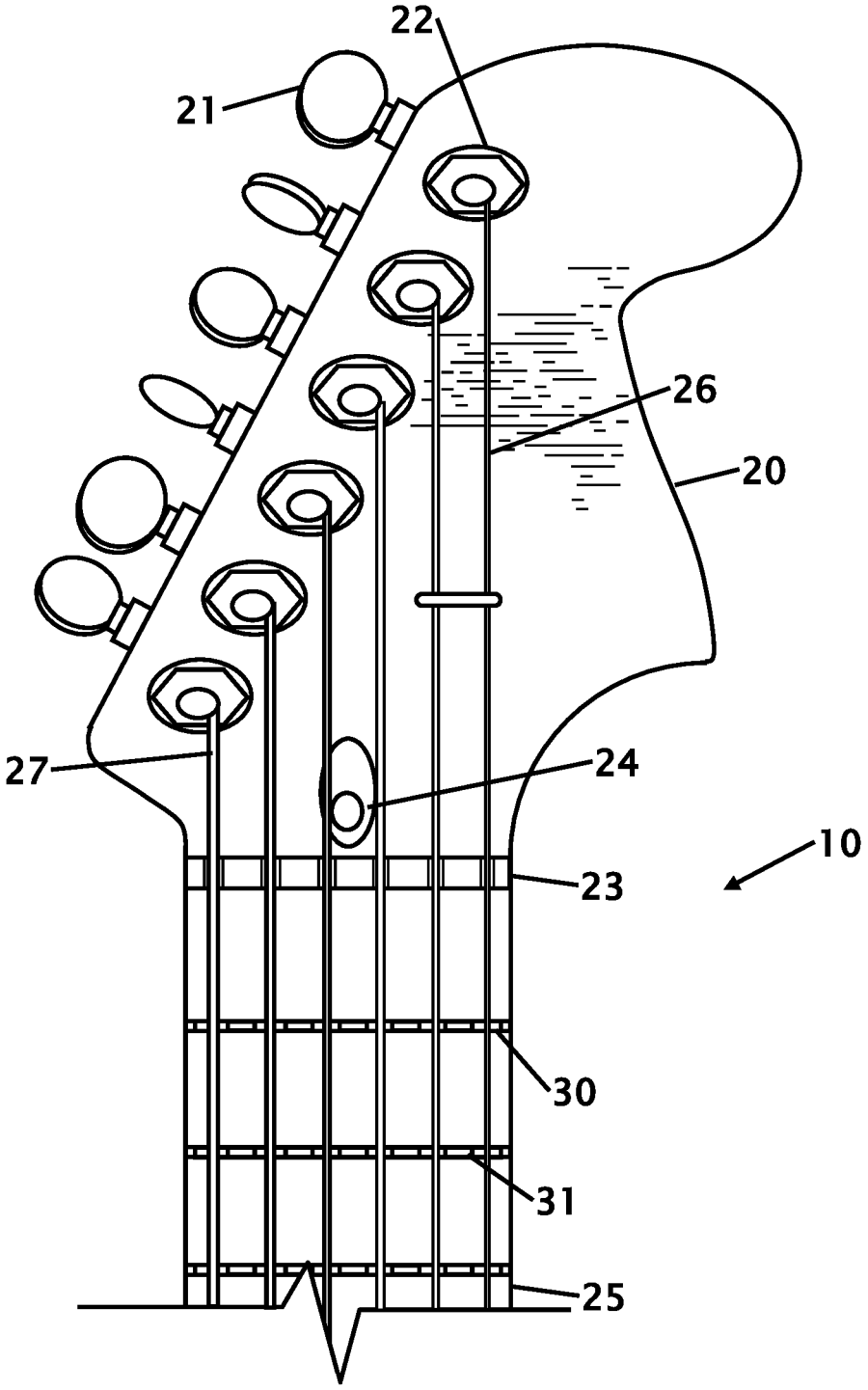
FIG. 4 shows the upper head of a guitar with grooved frets with a horizontal break in the frets.

FIG. 4 shows the upper head of a guitar with grooved 31 frets 30 with a horizontal break in the frets. This embodiment has slots between the frets but there is no elongated slot that actually cuts into the neck of the fingerboard as shown in FIG. 1. Each fret edge is angled to allow the string to make the proper tone when playing a note. There are multiple options for designing the neck. The low strings might not sound as good or give a good tone for doing fret corner bends. Therefore, the instrument can be designed with only a few slots placed in-between the higher strings as shown in other variations in this document.

FIG. 5 Slots 35 placed in between the $3^{rd}$ and $2^{nd}$ string, and the $5^{th}$ and $4^{th}$ string. In this embodiment slots are placed between the $3^{rd}$ and $2^{nd}$ string, and the $5^{th}$ and $4^{th}$ string. This allows a performer to bend all the strings over the edge while using the minimum number of slots. It limits a player from bending the strings up or down using the fret corner edge.

FIG. 6 has slots 35 placed in between the upper four strings, FIG. 7 has slots 35 placed in between the upper three strings and FIG. 8 has slots 35 placed in between the upper two strings. These contemplated variations allow a player to bend the $2^{nd}$ $3^{rd}$ and possibly the $4^{th}$ string over the fret corners. The $4^{th}$ $5^{th}$ and $6^{th}$ string might not sound as good. The fret corners are mainly for solos on the high strings.

FIG. 9 shows a guitar neck with fret corner slots at select locations 50 on the neck. A larger section of the stringed instrument 11 is shown in this figure with the neck 15 and all the frets 30. The body 12 of the guitar is shown with the pick-ups 14 that amplify the vibration of the strings that can be sent to speakers. The location of the slots 50 are shown placed at the same location as the dots 16 on the fingerboard, but the slots can be located at other locations, and between different strings. For this version slots can be created at specific frets or on specific areas of the neck.

FIG. 10 shows a fretless neck 15 embodiment with frets running the length of the fingerboard, and FIG. 11 is an oblique view of the fretless neck 15 with frets running the length of the fingerboard. FIG. 12 shows an oblique view of a portion of a fretless base guitar. The sides of the fingerboard have vertical metal fret corners that run along edges of the stringed instrument. The recesses 62 run parallel to the strings 63, 64, 65 and 66 and only exist between each sets of strings. There are also vertical metal fret corners 68 on each side of the elongated slots 67. There are scalloped elongated slots that can either be square, deep curved scallops or any of the variations shown and described in FIGS. 2A-2F. The slots 67 are angled with angled metal fret material 68 on the edge to obtain desired tonal effects. This figure also shows elongated metal frets 60 along the elongated sides of the fingerboard to allow a person to bend one or more strings along the side of the fingerboard. Most fretless instruments are played with bow, but other fretless instruments are bass instruments that are plucked.

FIG. 13 shows an oblique view of a portion of a fretted four string guitar 11. In this view the three groves or recesses 62 are displaced from the center of the four strings 63, 64, 65 and 66 and run parallel with the neck 25 of the guitar 11. At the far end of the neck 25 some tuning machines 21 can be seen. The width 67 of the grooves or recesses 62 allows a performer to bend the string(s) into the recesses 62. The grooves may also be wider near the body of the guitar and narrower and progressively narrower at the nut of the guitar.

It is contemplated that the grooved can be cut at different distances away from the strings at two or more points per string. The fretboard can have grooves cut at several places in between the strings to improve string bending on the lower frets and higher frets. This will allow proper distance of the string next to the groove on specific frets to make the technique of bending the string into the groove work properly. The lower frets require the groove be closer because they have less give to bend and the higher frets have more give to bend due to slack from excess string length and need more space between the groove to play comfortably so they don't go into the groove unintentionally with standard note playing on the fretboard.

It is further contemplated that the grooves can be cut at angles where the grooves do not run parallel to the strings. The grooves can be slanted away or toward the string at an angle. This allows different distances between the string and groove from top to bottom with the bottom being closer or further away. Adds more variety with playability and control when performing the X note edge bend technique of pulling the string into the groove.

Thus, specific embodiments of a guitar fret board design have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A stringed instrument finger board comprising:

a fingerboard on a stringed instrument having a top exposed surface with a plurality of strings spaced above said fingerboard;

said fingerboard having a plurality of parallel frets embedded into said fingerboard at a spacing that corresponds to desired notes from said strings on said stringed instrument;

said frets being elevated from said top exposed surface of said fingerboard and below an underside of said strings;

said frets having a first height whereby said notes are played and a second height;

said second height being essentially parallel to said top exposed surface of said fingerboard;

said second height is placed in areas between said plurality of strings, and said second height is a void in said fret.

2. The stringed instrument finger board according to claim 1, further includes frets that are placed parallel with said plurality of strings and running a length of said fingerboard.

3. The stringed instrument finger board according to claim 1, wherein said frets members are uniform, cylindrical fret bars.

4. The stringed instrument finger board according to claim 1, wherein said stringed instrument has at least four strings.

5. The stringed instrument finger board according to claim 1, wherein said stringed instrument is a guitar.

6. A stringed instrument finger board comprising:

a fingerboard on a stringed instrument having a top exposed surface with a plurality of strings spaced above said fingerboard;

said fingerboard having a plurality of parallel depressions in said fingerboard to a depth below said top exposed surface;

said depressions being located between at least two of said plurality of strings;

said frets being elevated from said top exposed surface of said fingerboard and below an underside of said strings;

said frets having a first height whereby said notes are played and a second height;

said second height being essentially parallel to said top exposed surface of said fingerboard;

said second height is placed in areas between said plurality of strings, and said second height is a void in said fret.

7. The stringed instrument finger board according to claim 6 wherein said plurality of parallel depressions have a bottom surface that is at least one of, square, round, rounded scalloped or angled.

8. The stringed instrument finger board according to claim 6, wherein said second height is a void in said fret.

9. The stringed instrument finger board according to claim 6, wherein said stringed instrument has at least four strings.

10. The stringed instrument finger board according to claim 6, wherein said stringed instrument is a guitar.

11. The stringed instrument finger board according to claim 6, wherein said stringed instrument is not a guitar.

12. A stringed instrument finger board comprising:

a fingerboard on a stringed instrument having a top exposed surface with a plurality of strings spaced above said fingerboard;

said fingerboard having a plurality of parallel depressions in said fingerboard to a depth below said top exposed surface;

said depressions being located between at least two of said plurality of strings;

said frets being elevated from said top exposed surface of said fingerboard and below an underside of said strings;

said frets having a first height whereby said notes are played and a second height;

said second height being essentially parallel to said top exposed surface of said fingerboard;

said second height is placed in areas between said plurality of strings, and said plurality of parallel depressions extend across at least two frets.

13. The stringed instrument finger board according to claim 12, wherein said plurality of parallel depressions have a bottom surface that is at least one of, square, round, rounded scalloped or angled.

14. The stringed instrument finger board according to claim 12, wherein said second height is a void in said fret.

15. The stringed instrument finger board according to claim 12, wherein said stringed instrument has at least four strings.

16. The stringed instrument finger board according to claim 12, wherein said stringed instrument is a guitar.

17. The stringed instrument finger board according to claim 12, wherein said stringed instrument is not a guitar.

* * * * *